United States Patent [19]

Barclay et al.

[11] 4,374,007

[45] Feb. 15, 1983

[54] TRIVALENT CHROMIUM ELECTROPLATING SOLUTION AND PROCESS

[75] Inventors: Donald J. Barclay; James M. L. Vigar, both of Winchester, England

[73] Assignee: International Business Machines Corporation, Armonk, N.Y.

[21] Appl. No.: 239,919

[22] Filed: Mar. 3, 1981

[30] Foreign Application Priority Data

Mar. 10, 1980 [GB] United Kingdom ..... 8008034
Feb. 16, 1981 [EP] European Pat. Off. ..... 81101075.0

[51] Int. Cl.[3] ..... C25D 3/06
[52] U.S. Cl. ..... 204/51
[58] Field of Search ..... 204/51, 43 R, 105 R, 204/123

[56] References Cited

U.S. PATENT DOCUMENTS 4,141,803 2/1979 Barclay et al. ..... 204/51
4,161,432 7/1979 Barclay et al. ..... 204/51

FOREIGN PATENT DOCUMENTS 301478 2/1929 United Kingdom ..... 204/51
1322939 7/1973 United Kingdom ..... 204/51
1333714 10/1973 United Kingdom ..... 204/51
1431639 4/1976 United Kingdom .
1455580 11/1976 United Kingdom ..... 204/51
1498532 1/1978 United Kingdom ..... 204/51
1498533 1/1978 United Kingdom ..... 204/51
1544833 4/1979 United Kingdom ..... 204/51
1552263 9/1979 United Kingdom ..... 204/51
1562188 3/1980 United Kingdom ..... 204/51

*Primary Examiner*—G. L. Kaplan
*Attorney, Agent, or Firm*—Francis A. Sirr

[57] ABSTRACT

A chromium electroplating solution in which the source of chromium comprises an equilibrated aqueous solution of chromium (III) - thiocyanate complexes having supporting electrolyte consisting essentially of potassium sulphate or, preferably, a mixture of potassium and sodium sulphates. The solution is employed as the catholyte in a plating bath in which the catholyte and anolyte are separated by a cation exchange membrane. This all-sulphate bath permits the use of lead anodes, has high efficiency and a good plating range.

13 Claims, No Drawings

TRIVALENT CHROMIUM ELECTROPLATING SOLUTION AND PROCESS

DESCRIPTION

Technical Field

This invention relates to the field of chromium electroplating solutions and baths in which the source of chromium comprises an equilibrated aqueous solution of chromium (III) - thiocyanate complexes.

BACKGROUND OF THE INVENTION

The advantages of plating chromium from an equilibrated aqueous solution of chromium (III) - thiocyanate complexes over conventional chromic acid plating are elaborated in our U.K. Pat. No. 1431639. Refinements and modifications of this basic process have been described in later patents among which are U.S. Pat. Nos. 4,141,803 and 4,161,432. The benefits to the trivalent chromium process of an anolyte and catholyte separated by a cation exchange membrane are described in pending U.K. patent application No. 13458/78. Finally pending U.K. patent applications Nos. 44177/78 and 7932300 describe a related solution and process in which beneficial effects are obtained from a reduction in the level of chromium and thiocyanate concentration to levels well below those originally contemplated by those skilled in the art.

Equilibrated chromium (III) - thiocyanate complexes from which plating takes place have been prepared from a variety of starting materials. The originally preferred starting salts of U.K. Pat. No. 1431639 were chromium perchlorate and sodium thiocyanate. In order to make the solution sufficiently electrically conductive additional sodium perchlorate was added as a supporting electrolyte. U.S. Pat. No. 4,141,803 proposed hexathiocyanatochromium salts of potassium or sodium ($K_3Cr(NCS)_6$ or $Na_3Cr(NCS)_6$) to which sodium perchlorate or sodium sulphate was added as a conductivity salt. Potassium sulphate was also mentioned as a possible conductivity salt but no example was given. In U.S. Pat. No. 4,161,432 one preferred solution was prepared from chromium chloride ($CrCl_3$) and sodium thiocyanate. Potassium chloride was added for conductivity. A second preferred solution was prepared from chromium sulphate ($Cr_2(SO_4)_3$) and sodium thiocyanate. In this case sodium sulphate was added for conductivity.

In pending U.K. application No. 13458/78, in which a catholyte and anolyte are separated by a membrane, the catholyte was prepared from chromium sulphate ($Cr_2(SO_4)_3$) and sodium thiocyanate, and sodium chloride was added for conductivity. The anolyte consisted of an aqueous solution of a depolarising agent to which sodium sulphate ($Na_2SO_4$) was added for conductivity. The advantage of having sodium sulphate in the anolyte rather than sodium chloride is that chlorine evolution from the anode is very much reduced. The electrolyte employed in pending U.K. application No. 7932300 has essentially similar constituents to that of U.K. application No. 13458/78 except that the concentration of chromium is below 0.03 molar and the concentration of thiocyanate is also proportionally reduced.

It is found that in plating chromium from electrolytes as described in U.K. application Nos. 13458/78 and 7932300, with catholyte and anolyte separated by a cation exchange membrane, chloride ions from the catholyte are, in practice, able to penetrate the membrane is sufficient numbers to give significant chlorine evolution at the anode. This is not only environmentally undesirable but prevents the use of cheap lead anodes because of formation of lead chloride thereon. Instead, platinized titanium anodes have had to be used. A further problem with baths having chloride anions in the catholyte is that pH stability is poor and needs frequent adjustment.

The Invention

The above stated disadvantages of a chloride supporting electrolyte point to the use of a sulphate. Several examples of the use of sodium sulphate as a conductivity salt for a supporting electrolyte are given in the above listed prior art. This salt is cheap and readily soluble. No noxious anode gases are liberated and the pH stability of the path is improved. However, the efficiency and plating current density range of trivalent chromium/thiocyanate plating baths employing sodium sulphate rather than the chloride are found to be materially reduced. It is hypothesized that the reason for this deterioration in performance may be complexing between the sulphate ions and the chromium-thiocyanate complexes which tends to hinder mobility and electrochemical activity of the complexes in solution.

The present invention stems from the discovery that potassium sulphate as a conductivity salt for a supporting electrolyte does not cause such a deterioration in performance of the trivalent chromium plating process. Potassium sulphate had been suggested as a possible conductivity salt in U.S. Pat. No. 4,141,803 but no examples of its use or suggestions of this advantage were given. Using potassium sulphate the efficiency of the bath was found to improve. However it was also observed that, although plating was possible at much higher current densities than with the sodium sulphate bath, it was not possible at such low current densities as with the sodium sulphate bath.

Since there is a direct relationship between current density and plating voltage for a given electrolyte, this higher minimum current density requirement dictates a higher minimum plating voltage.

Accordingly, the present invention provides a chromium electroplating solution comprising an equilibrated aqueous solution of chromium (III) - thiocyanate complexes as the source of chromium and a supporting electrolyte consisting essentially of a mixture of sodium and potassium sulphates in a concentration sufficient to provide electrical conductivity for the plating process.

By using a mixture of both these salts as the supporting electrolyte, both high efficiency and a wide plating range can be achieved without the need for high plating voltages. In preferred examples, efficiencies of up to 9.5% (at 60 $mAcm^{-2}$, 60° centigrade and pH 3.5) and a plating range of 10–1000 $mAcm^{-2}$ have been achieved.

One reason for the beneficial effect of the potassium sulphate on efficiency and plating range is believed to be that the potassium preferentially ion-pairs with the sulphate in solution thus leaving the mobility of the chromium (III) - thiocyanate complexes largely unaffected. To maximize the benefit, it is preferred that the potassium sulphate should be present in saturation concentration.

It is also preferred that the concentration of sodium sulphate is less than or equal of 1 Molar. Otherwise, with a greater proportion of sodium sulphate than this, efficiency begins to fall of again. The optimum concentration of sodium sulphate appears to be around 0.5 Molar.

Considering now, in particular, a trivalent chromium/thiocyanate bath having anolyte and catholyte separated by a cation exchange membrane, the basic reason for the use of such a membrane is to prevent anodic oxidation of bath constituents at the anode. As a result of the blocking of thiocyanate anions by the membrane, water, instead, is oxidised at the anode resulting in a steady input of hydrogen ions to the anolyte. The flux of these hydrogen ions through the membrane into the catholyte is important in that it maintains the acidity of the catholyte which would otherwise decrease because of the steady evolution of hydrogen at the cathode. Thus the membrane acts to stabilize pH.

The presence of chloride ions in the catholyte but not the anolyte is believed to reduce this pH stabilizing effect on the catholyte somewhat. The reason for this is not entirely clear but could be connected with the concentration differential of chloride across the membrane. As noted above this leads to an inward flux of chloride ions to the anolyte. It is possible that the flux of chloride ions acts to reduce the outward flux of hydrogen ions from anolyte to catholyte. Also the rate of production of hydrogen ions in the anolyte by electrolysis of water will be reduced because of the preferential oxidation of the chloride ions.

This additional problem is solved according to another aspect of the present invention, without greatly affecting the bath efficiency, by providing a chromium electroplating bath comprising an anloyte and a catholyte separated by a cation exchange membrane, the catholyte being chloride free and comprising an equilibrated aqueous solution of chromium (III) - thiocyanate complexes and a supporting electrolyte comprising at least potassium sulphate in a concentration sufficient to provide electrical conductivity for the plating process, and the anolyte also being chloride free and comprising sulphate ions in aqueous solution.

The plating range of an all potassium sulphate catholyte may be considered inadequate in which case sodium sulphate is preferably added in an amount sufficient to increase the range without reducing efficiency to an unacceptable degree.

Sulphate ions in the anolyte are preferably provided as an aqueous solution of sulphuric acid.

One further important consequence of the chloride free bath is that its anode may be of lead rather than platinized titanium.

Quantitative results have been obtained from plating experiments performed in a Hull cell. The electrolyte employed was one of 0.012M chromium concentration including, thiocyanate and aspartic acid as complexants, the conductivity salts, and boric acid as a pH buffer.

In addition to Hull cell experiments, larger baths have been operated for periods of up to several months. In these baths both potassium sulphate alone and also a mixture of potassium and sodium sulphates have been used as conductivity salts. The larger baths have an anolyte and catholyte separated by a cation exchange membrane. Topping up of these baths with "chrometan" (hydrated chromium sulphate) and thiocyanate anions replaces depleted chromium without altering the essential composition of the bath. Adjustment of pH, when necessary, can be effected with a mixture of potassium and sodium hydroxides in the same proportion as the conductivity salt mixture.

The invention will now be described further with reference to the following comparative examples and examples.

Comparative Example I

A concentrated chromium plating solution was first prepared in the following manner:

(a) 60 grams of boric acid ($H_3BO_3$) were added to 750 ml of deionised water which was then heated and stirred to dissolve the boric acid.

(b) 33.12 grams of chromium sulphate ($Cr_2(SO_4)_3.15H_2O$) and 16.21 grams of sodium thiocyanate (NaNCS) were added to the solution which was then heated and stirred at approximately 70° C. for about 30 minutes.

(c) 16.625 grams of DL aspartic acid ($NH_2CH_2CH(COOH)_2$) were added to the solution which was then heated and stirred at approximately 75° C. for about 3 hours. During this time the pH was adjusted from pH 1.5 to pH 3.0 very slowly with a 10% by weight sodium hydroxide solution. Once the pH of 3.0 was achieved it was maintained at this value for the whole of the equilibration period.

(d) Sufficient sodium chloride was added to the solution to make it approximately 1M concentration and 0.1 grams of FC 98 (a wetting agent produced by 3M Corporation) was also added. The solution was heated and stirred for a further 30 minutes.

(e) The solution pH was again adjusted to pH 3.0 with sodium hydroxide solution.

(f) The solution was made up to 1 liter with deionised water which had been adjusted to pH 3.0 with a 10% by volume solution of hydrochloric acid.

The concentrated solution composition may be expressed as:

0.1 M chromium sulphate —$Cr_2(SO_4)_3.15H_2O$
0.2 M sodium thiocyanate—NaNCS
0.125 M aspartic acid— $NH_2CH_2CH(COOH)_2$
60 g/l boric acid—$H_3BO_3$
60 g/l sodium chloride—NaCl
0.1 g/l FC 98—(wetting agent product of 3M Corp)

As a result of the equilibration process, the bulk of the chromium in the final solution is believed to be in the form of chromium/thiocyanate/aspartic complexes.

120 mls of this solution were made up to 1 liter with a solution containing 60 grams per liter of boric acid and 60 grams per liter of sodium chloride.

The final solution composition (omitting the wetting agent) was:

0.012 M Chromium sulphate
0.024 M sodium thiocyanate
0.015 M aspartic acid
60 g/l boric acid
60 g/l sodium chloride This solution was introduced into a Hull cell having a standard brass Hull cell panel connected as a cathode and a platinized titanium anode. At a temperature of 60° C. and a solution pH adjusted to 3.5, a total current of 10 amps was passed through the Hull cell to produce a bright deposit of chromium on the test plate. To sustain the plating current required a voltage of 10.6 volts applied to the cell. Examination of the Hull cell test panel indicated acceptably bright plating within a current density range of 10–700 $mAcm^{-2}$. Efficiency measurements were made in a separate cell, employing an anode bag, and filled with a plating solution of the above composition as catholyte. The anode bag was a perfluorinated cation exchange membrane separating the catholyte from a separate anolyte comprising an aqueous solution of sulphuric acid in 2% by volume concentration. The plating efficiency of this solution was calculated from the results of these separate experiments to be 8% falling to 6% after plating for 4 Ampere hours per liter. The efficiency was measured at a current density of 75 $mAcm^{-2}$, a temperature of 60° C. and a pH of 3.5. Despite the membrane chloride ions were detected in the anolyte in concentrations up to approximately 0.5M, resulting in the evolution of chlorine at the anode, furthermore the pH of the bath began to rise quickly and had to be adjusted frequently.

Comparative Example II

Two plating solutions were made up exactly as for Comparative Example I except that sodium sulphate ($Na_2SO_4$) replaced sodium chloride as the conductivity salt. One solution had a 1 molar concentration of sodium sulphate and the other had a 2 molar concentration.

The solutions were introduced as electrolytes into a Hull cell with the same anode as for Comparative Example I. Test panels were plated at 10 amps total current to produce bright chromium deposits. In all experiments, the temperature was 60° C. and the solution pH was adjusted to 3.5.

For the 1M sodium sulphate electrolyte, 15.2 volts were needed across the cell to sustain the current. The current density plating range in the Hull cell was 20–600 $mAcm^{-2}$. for the 2M sodium sulphate electrolyte, 13.2 volts were needed to sustain the current of 10 amps. The plating range was reduced as compared with the chloride conductivity salt to 10–500 $mAcm^{-2}$.

In further experiments, efficiencies were measured in a separate cell having an anode membrane and anolyte as for Comparative Example 1 and employing the 1M and 2M sodium sulphate plating solutions as catholytes. For the 1M sodium sulphate catholyte, the initial efficiency of the solution, as measured at a current density of 50–55 $mAcm^{-2}$, a temperature of 60° C. and a pH of 3.5 was 7.0%. For the 2M sodium sulphate catholyte, the initial efficiency measured separately under the same conditions as above was 7.5% but fell rapidly to a sustained efficiency of 4.5%.

Since no chloride was employed no chlorine could be evolved at the anode. However, the sustained efficiency and plating range of the sodium sulphate bath were reduced as compared with chloride bath.

EXAMPLE I

A plating solution was made up in the manner of Comparative Example I except that potassium sulphate ($K_2SO_4$) replaced sodium chloride as the conductivity salt, potassium hydroxide was used instead of sodium hydroxide and potassium thiocyanate replaced sodium thiocyanate. The potassium sulphate was present in saturation concentration and was prepared from potassium hydrogen sulphate.

This plating solution was introduced, as the catholyte, into a cell having the same anode, anolyte and membrane arrangement as for the Comparative Examples.

Efficiency measurements were made at a current density of 50–55 $mAcm^{-2}$, a temperature of 60° C. and an adjusted pH of 3.5. The initial efficiency of the solution was measured to be 9% and fell only to 8.5% over a long period of time. Thus, a bath employing potassium sulphate for conductivity has significantly better current efficiency than one employing sodium sulphate (c.f. Comparative Example II).

The pH stability of this bath is also better than the bath of Comparative Example I. The solution pH only rose from 3.5 to 4.0 after 40 ampere hours per liter of charge had passed. It was then adjusted back to 3.5 using sulphuric acid. It will be recalled that the membrane acts to stabilize pH by allowing electrolysis of water at the anode instead of other reactions which would occur preferentially with catholyte components. The hydrolysis produces hydrogen ions which can pass through the membrane to replace those lost by hydrogen evolution at the cathode. It is believed that since sulphate will not pass through the membrane, the flux of hydrogen ions is greater than it would be with chloride in the catholyte. Also sulphate, unlike chloride does not preferentially oxidise at the anode thereby allowing the maximum number of hydrogen ions to be generated.

In order to determine plating range and minimum plating voltage, the plating solution of this example was introduced as the electrolyte into a Hull cell. Test panels were plated at a total current of 10 amps to produce bright chromium deposits. The solution temperature was 60° C. and its pH was adjusted to 3.5. A voltage of 11.9 volts was need to sustain this plating current. The plating range in the Hull cell was from 25 to approximately 1000 $mAcm^{-2}$. The upper limit could not be precisely determined because the test plate was plated right to the top edge. As compared with a bath employing sodium sulphate for conductivity, a bath employing potassium sulphate has an extended upper limit of plating current density but the lower threshold for plating was raised.

Thus potassium sulphate has advantages as a conductivity salt particularly in a bath with a membrane. It does however have the disadvantage that the lower end of the plating range is rather hgh at 25 $mAcm^{-2}$. As explained earlier this higher minimum current density requirement implies a higher minimum plating voltage than would otherwise be required. This may be a disadvantage in a working environment where there is only a limited supply voltage available.

EXAMPLE II

A plating solution was made up in the manner of Example I but, in addition to the potassium sulphate in 1 Molar concentration, sodium sulphate was also added in 0.5 Molar concentration.

The mixed conductivity salt plating solution was introduced into an electroplating cell as the catholyte with the same anode, anolyte and membrane arrangement as for the previous examples. The initial efficiency of plating was measured, under the same conditions as for Example I, to be 8%.

In separate experiments, the same plating solution was introduced as the electrolyte into a Hull cell under the same conditions as for Example I. Test panels were plated at a total cell current of 10 amps to produce bright chromium deposits. A voltage of 11.2 volts was needed to sustain this current. The plating range in the Hull cell was from 10 to approximately 1000 $mAcm^{-2}$. This is wider than for Example I or Comparative Examples I and II. This implies a significantly lower minimum voltage for satisfactory plating in a working bath than would be needed for an all potassium bath. Thus, a bath employing a mixture of sodium and potassium sulphate as conductivity salts has both high efficiency and good plating range while overcoming the deficiencies of chloride conductivity salts.

EXAMPLE III

Several plating solutions were made up in the manner of Example II but having different concentrations of sodium sulphate.

Plating experiments were conducted in the manner of Example II. In each case, the voltage needed to sustain a current of 10 amps and the current density plating range were determined in a Hull cell. The initial plating efficiencies were determined under the same conditions as for Example I, in a separate cell employing an anode membrane. Sustained efficiencies were not measured.

The following results were obtained:

| Sodium sulphate concentration | Hull cell voltage | Plating Range $mAcm^2$ | Initial Efficiency % |
|---|---|---|---|
| 0.1 M | 11.6 | 20–1000 | 7–8 |
| 0.3 M | 11.3 | 10–1000 | 7–8 |
| 1.0 M | 11.2 | 10–700 | 6 |

EXAMPLE IV

A plating solution was made up in the manner of Example II but with the difference that sodium thiocyanate, rather than potassium thiocyanate was employed in equal molar concentration (0.012M) chromium sulphate. Another difference was that the concentration of boric acid was increased from 60 to 75 g/l.

Expressed in terms of its initial constituents the composition of the solution was:

0.012 M chromium sulphate
0.012 M sodium thiocyanate
0.015 M aspartic acid
75 g/l boric acid
0.5 M sodium sulphate
1.0 M potassium sulphate Hull cell experiments were conducted at a temperature of 60° C. and a solution pH adjusted to 3.5. The plating range was 10 to approximately 1000 $mAcm^{-2}$. Since the supporting electrolyte is the same as for Example II, this implies that a similar plating voltage as for Example II would be necessary to sustain an overall current of 10 amps, through this voltage was not, in fact, measured.

However, the initial efficiency measured separately in the manner of Example II, improved to 9.5%. The solution temperature was again 60° C. and the solution pH was 3.5 but the current density was 60 $mAcm^{-2}$.

It was also observed that the bright chromium deposits produced in these experiments were lighter in colour than those produced in Example II.

What is claimed is:

1. An aqueous chromium electroplating solution comprising chromium (III) and thiocyanate ions and a supporting electrolyte which is chloride free, and a mixture of sodium and potassium sulphate in a concentration sufficient to provide electrical conductivity for the plating process, the concentration of sodium sulphate being in the range of about 0.1 to 1 Molar, and the concentration of potassium sulphate being about 1 Molar.

2. The solution of claim 1 wherein the sodium sulphate concentration is about 0.5 Molar.

3. The solution of claim 1 or 2 including aspartic acid and boric acid

4. The solution of claim 1 or 2 including aspartic acid and boric acid, and in which the source of chromium is chromium sulphate.

5. A chromium electroplating solution comprising an aqueous solution of chromium (III) complexes as the source of chromium and a supporting electrolyte which is chloride free and comprises a mixture of sodium and potassium sulphates in a concentration sufficient to provide electrical conductivity for the plating process, the concentration of sodium sulphate being in the range of about 0.1 to 1 Molar, and the concentrating of potassium sulphate being about 1 Molar.

6. A solution as claimed in claim 5 wherein the sodium concentration is 0.5 Molar.

7. A solution as claimed in claim 6 further including aspartic acid and boric acid, and wherein the source of chromium is chromium sulphate.

8. A method of plating chromium comprising the step of providing an electroplating bath of an anolyte and a catholyte separated by a cation exchange membrane, the catholyte including aspartic acid and boric acid, being chloride free and comprising chromium (III) and thiocyanate ions and a supporting electrolyte comprising at least potassium sulphate in a saturated concentration sufficient to provide electrical conductivity for plating, and the anolyte also being chloride free and comprising sulphate ions in aqueous solution.

9. The method of claim 8 in which the supporting electrolyte comprises a mixture of sodium and potassium sulphates in solution, the concentration of sodium sulphate being in the range of about 0.1 to 1 Molar, and the concentration of potassium sulphate being about 1 Molar.

10. The method of claim 9 in which sodium sulphate is present in a concentration of about 0.5 Molar.

11. The method of claim 8, 9 or 10 in which the source of chromium is chromium sulphate.

12. The method of claim 8, 9 or 10 in which the source of chromium is chromium sulphate, and in which the anolyte is substantially an aqueous solution of sulphuric acid.

13. The method of claim 8, 9 or 10 in which the source of chromium is chromium sulphate, in which the anolyte is substantially an aqueous solution of sulphuric acid, and including the step of providing a lead anode.

* * * * *